US011291095B1

(12) United States Patent
Chan et al.

(10) Patent No.: US 11,291,095 B1
(45) Date of Patent: Mar. 29, 2022

(54) COUPLING COMPENSATION MODULE AND LIGHT EMITTING DIODE DRIVER THEREOF

(71) Applicant: NOVATEK Microelectronics Corp., Hsin-Chu (TW)

(72) Inventors: Tso-Sheng Chan, Kaohsiung (TW); Jin-Yi Lin, Kaohsiung (TW); Chun-Fu Lin, Taoyuan (TW); Jhih-Siou Cheng, New Taipei (TW); Yu-Sheng Ma, Taichung (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 17/216,666

(22) Filed: Mar. 29, 2021

(51) Int. Cl.
*H05B 45/39* (2020.01)

(52) U.S. Cl.
CPC ..... *H05B 45/39* (2020.01)

(58) Field of Classification Search
None
See application file for complete search history.

(56) References Cited

U.S. PATENT DOCUMENTS

2010/0123411 A1* 5/2010 Godbole ..... H05B 45/10 315/291
2012/0268015 A1* 10/2012 Sun ..... H05B 45/28 315/136
2014/0333217 A1* 11/2014 Lee ..... H05B 45/46 315/187

* cited by examiner

*Primary Examiner* — Jany Richardson
(74) *Attorney, Agent, or Firm* — Winston Hsu

(57) ABSTRACT

A coupling compensation module is provided, for compensating a channel voltage of a channel outputted by a constant current circuit of a light emitting diode (LED) driver. The coupling compensation module includes a detecting circuit, for detecting a voltage variation of the channel voltage, to generate a detection result; and a compensation circuit, for compensating the voltage variation of the channel voltage according to the detection result.

22 Claims, 9 Drawing Sheets

COUPLING COMPENSATION MODULE AND LIGHT EMITTING DIODE DRIVER THEREOF

BACKGROUND OF THE INVENTION

1. Field of the Invention

The present invention relates to a coupling compensation module and light emitting diode driver thereof, and more particularly, to a coupling compensation module and light emitting diode driver thereof capable of compensating the voltage variation of each channel due to capacitive coupling, and thus drives LED pixels of the LED panel to display desirable brightness.

2. Description of the Prior Art

In the art of light emitting diode (LED) driving, there are passive matrix common cathode driving structures and passive matrix common anode driving structures. Please refer to FIG. 1 and FIG. 2. FIG. 1 is a schematic diagram of a passive matrix common cathode driving structure, and FIG. 2 is a schematic diagram of a passive matrix common anode driving structure. As shown in FIG. 1, the passive matrix common cathode driving structure connects anodes of light emitting diode pixels in each column of a matrix to each channel of each constant current source of an LED driver 10 via each pulse width modulation (PWM) switch, while connecting cathodes of light emitting diode pixels in each row of the matrix to each scan line to a ground via each scan switch. When a specific column and a specific row are turned on via a timing controller 100, a light emitting diode pixel at the intersection emits light.

Similarly, as shown in FIG. 2, the passive matrix common anode driving structure connects cathodes of light emitting diode pixels in each column of a matrix to each channel of each constant current source of an LED driver 20 via each channel switch, while connecting anodes of light emitting diode pixels in each row of the matrix to each scan line to a supply voltage via each scan switch. When a specific column and a specific row are turned on via a timing controller 200, a light emitting diode pixel at the intersection emits light.

Under the passive matrix driving structures, when a specific channel of the light emitting diode driver 10 or 20 is turned on, if another channel of the light emitting diode driver 10 or 20 is simultaneously switched from turned on to turned off or switched from turned off to turned on, a channel voltage of the specific channel will fall or rise due to capacitive coupling.

For example, please refer to FIG. 3 and FIG. 4. FIG. 3 is a schematic diagram of an LED display panel 30 with an assembly and extension structure, and FIG. 4 is a schematic diagram of an image displayed by the LED display panel 30 shown in FIG. 3. As shown in FIG. 3, the LED display panel 30 includes light emitting diode drivers 300, 302 for driving light emitting diode pixels in the left part and the right part, respectively. When scan lines S1, SX1 are connected to a ground via corresponding scan switches, channels ch1-chX, chX+1-ch2X are turned on with respective conduction intervals in a PWM manner, to drive corresponding light emitting diode pixels in the first row with respective desirable brightness.

Under such a situation, when a specific channel (e.g. the channel chX) is turned on, if another channel (e.g. one of the channels ch1-ch3) is simultaneously switched from turned on to turned off, a channel voltage of the specific channel will fall due to capacitive coupling. For example, when the channel ch1 is switched from turned on to turned off at a time Tl, the channel voltage of the channel ch1 (connected to anodes of LED capacitors in the channel ch1) drops and thus voltages of scan lines S2-SY (connected to cathodes of the LED capacitors in the channel ch1) drop due to voltage coupling of the LED capacitors in the channel ch1. Since the scan lines S2-SY are connected to cathodes of the LED capacitors in the channels ch2-chX, the channel voltages of the channels ch2-chX (connected to anodes of the LED capacitors in the channels ch2-chX) drop due to voltage coupling of the LED capacitors in the channels ch2-chX, such that constant current sources of the channels ch2-chX need to provide currents to charge the LED capacitors in the scan line S1 as well as the scan lines S2-SY (as illustrated in the channel chX). By the same token, voltage variations of the channels chX+1-ch2X and the scan lines SX1-SXY can be derived.

Therefore, when the channels ch1-chX are turned on simultaneously and turned off according to respective conduction intervals, since the channel chX has a longest conduction interval, the channel voltage of the channel chX drops when the channels ch1-chX-1 are switched from turned on to turned off, respectively. As a result, even if the channels chX, chX+1 are configured with the same conduction interval (i.e. pulse width) to show the same brightness, since the channel voltage of the channel chX drops X−1 times during driving and the channel voltage of the channel chX+1 does not drop during driving, the area displayed by the channel chX is darker than the area displayed by the channel chX+1 and thus there is unsmooth in between as shown in FIG. 4.

Similarly, please refer to FIG. 5, which is a schematic diagram of another operation of the LED display panel 30 shown in FIG. 3. When a specific channel (e.g. the channel chX) is turned on, if another channel (e.g. one of the channels ch1-ch3) is simultaneously switched from turned off to turned on, a channel voltage of the specific channel will rise due to capacitive coupling. Therefore, when the channels ch1-chX are turned off simultaneously and turned on according to respective conduction intervals, since the channel chX has a longest conduction interval, the channel voltage of the channel chX rises when the channels ch1-chX-1 are switched from turned off to turned on, respectively. As a result, even if the channels chX, chX+1 are configured with the same conduction interval (i.e. pulse width) to show the same brightness, since the channel voltage of the channel chX rises X−1 times during driving and the channel voltage of the channel chX+1 does not rise during driving, the area displayed by the channel chX is brighter than the area displayed by the channel chX+1 and thus there is unsmooth in between (not shown).

Therefore, it is necessary to improve the conventional technology.

SUMMARY OF THE INVENTION

It is therefore an objective of the present invention to provide a coupling compensation module and light emitting diode driver thereof capable of compensating the voltage variation of each channel due to capacitive coupling, and thus drives LED pixels of the LED panel to display desirable brightness.

The present invention discloses a coupling compensation module, for compensating a channel voltage of a channel outputted by a constant current circuit of a light emitting diode (LED) driver. The coupling compensation module includes a detecting circuit, for detecting a voltage variation of the channel voltage, to generate a detection result; and a compensation circuit, for compensating the voltage variation of the channel voltage according to the detection result.

The present invention further discloses alight emitting diode (LED) driver, for driving an LED panel. The LED driver includes a constant current circuit, for outputting a channel voltage of a channel; and a coupling compensation module. The coupling compensation module includes a detecting circuit, for detecting a voltage variation of the channel voltage, to generation a detection result; and a compensation circuit, for compensating the voltage variation of the channel voltage according to the detection result.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
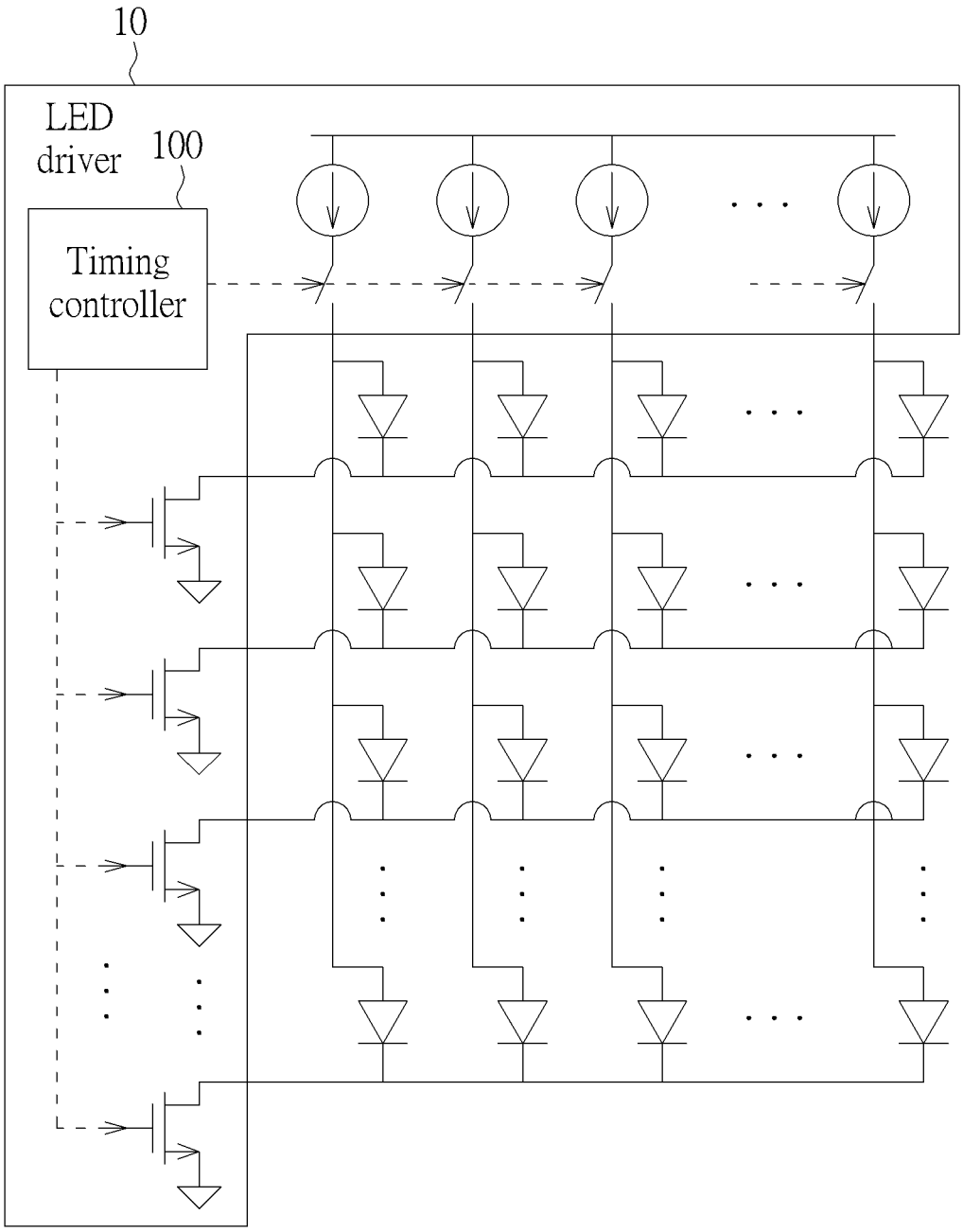
FIG. 1 PRIOR ART
FIG. 1 is a schematic diagram of a passive matrix common cathode driving structure.
Figure 3:
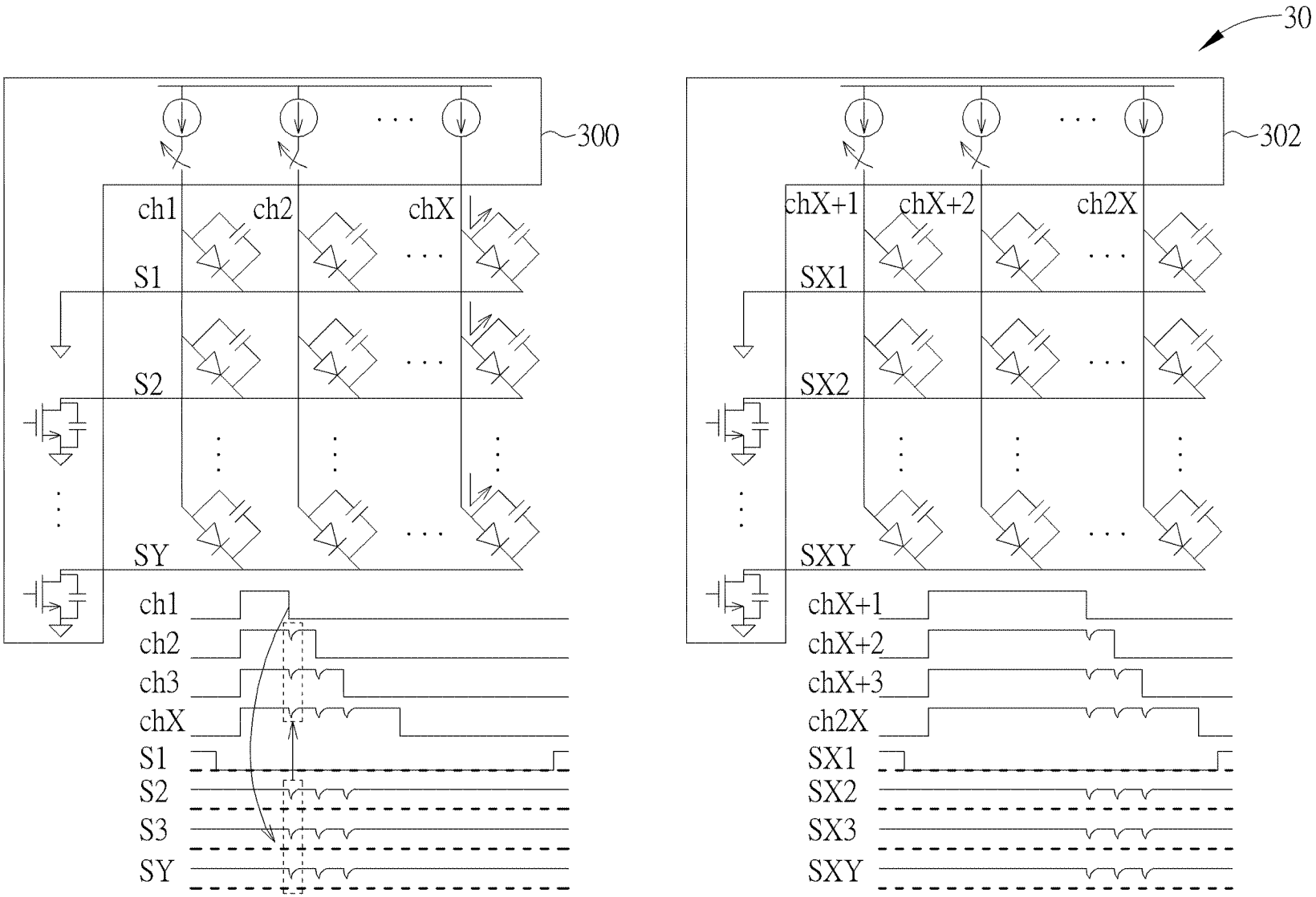
FIG. 3 PRIOR ART
FIG. 3 is a schematic diagram of an LED display panel with an assembly and extension structure.
Figure 4:
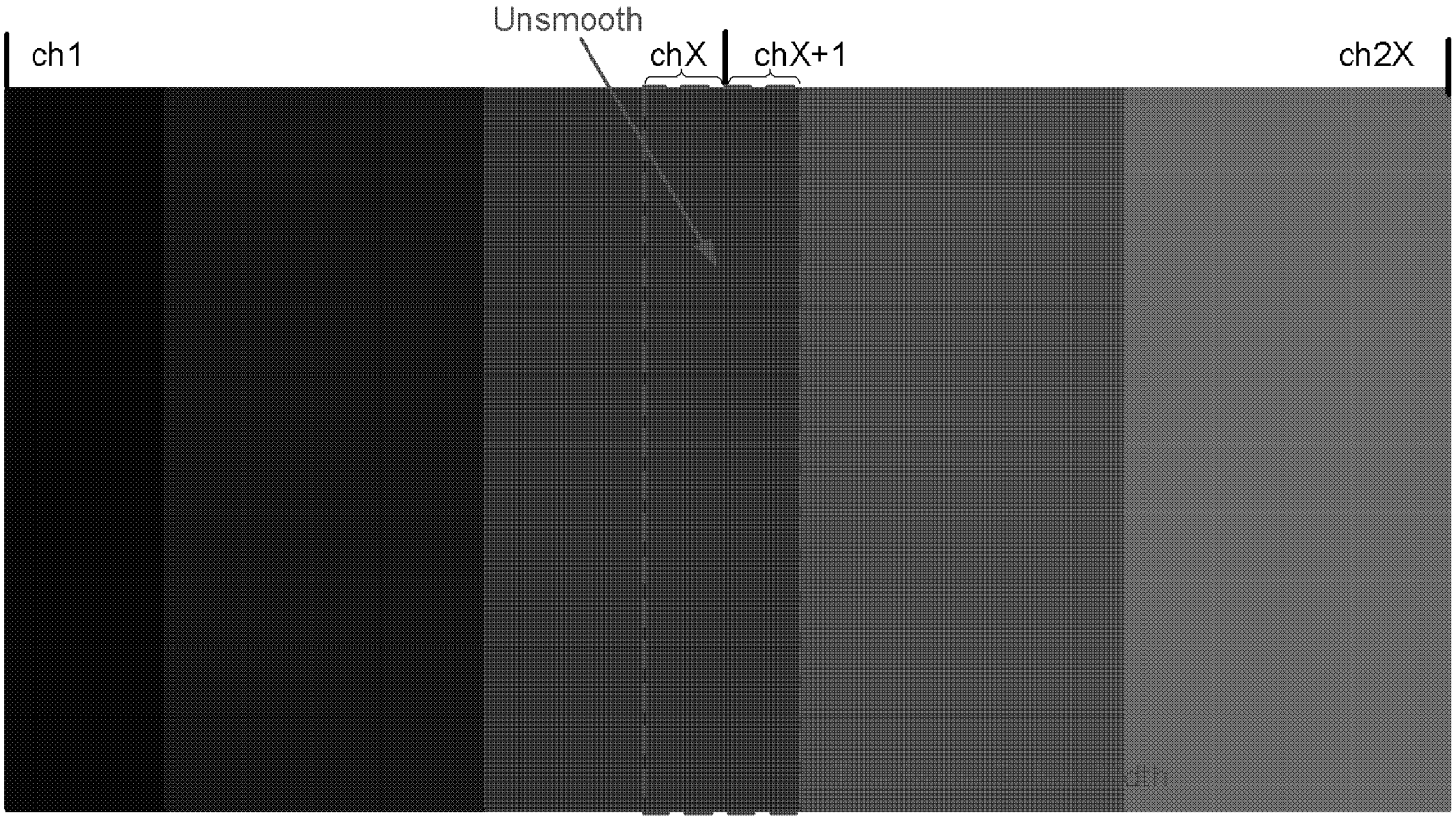
FIG. 4 PRIOR ART
FIG. 4 is a schematic diagram of an image displayed by the LED display panel shown in FIG. 3.
Figure 5:
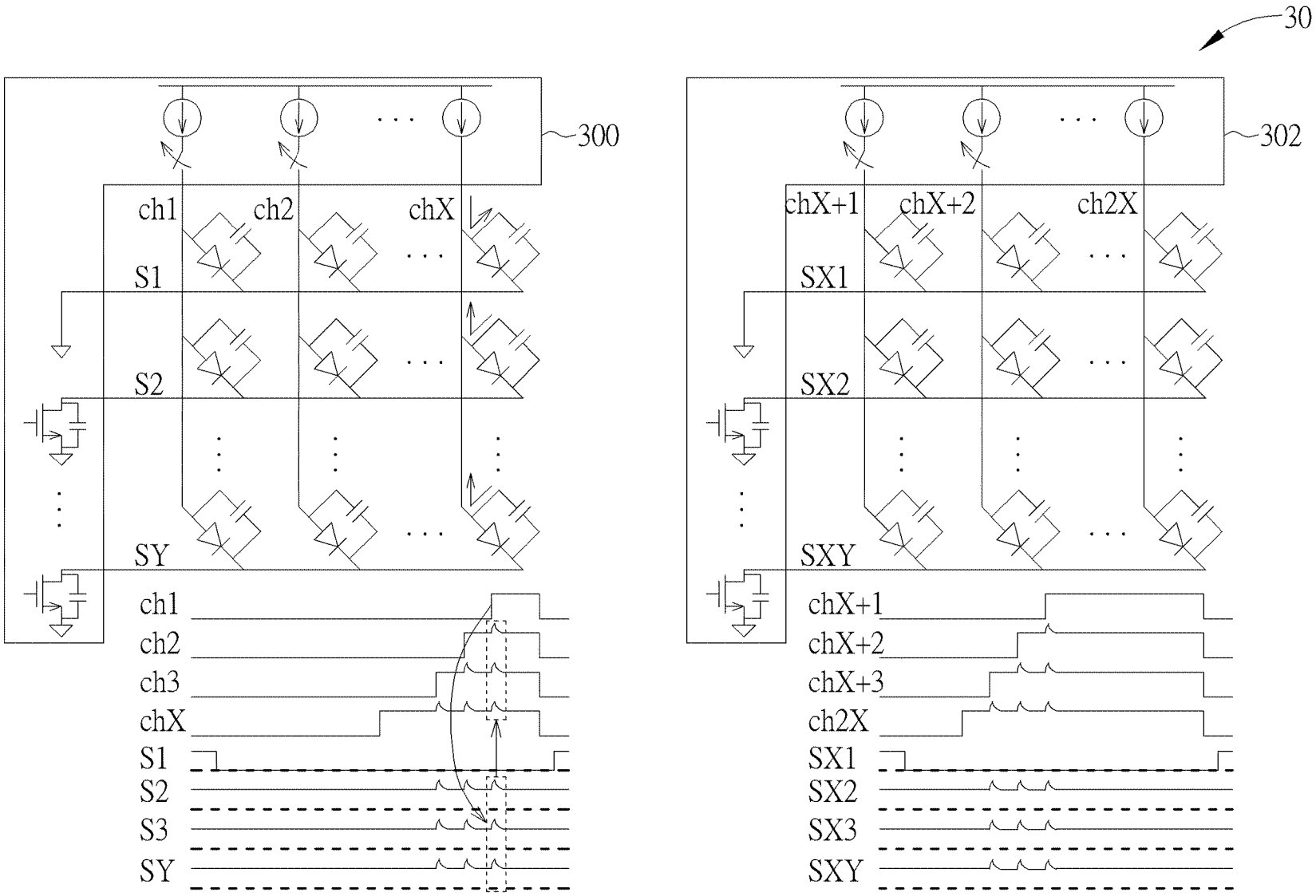
FIG. 5 PRIOR ART
FIG. 5 is a schematic diagram of another operation of the LED display panel shown in FIG. 3.
Figure 6:
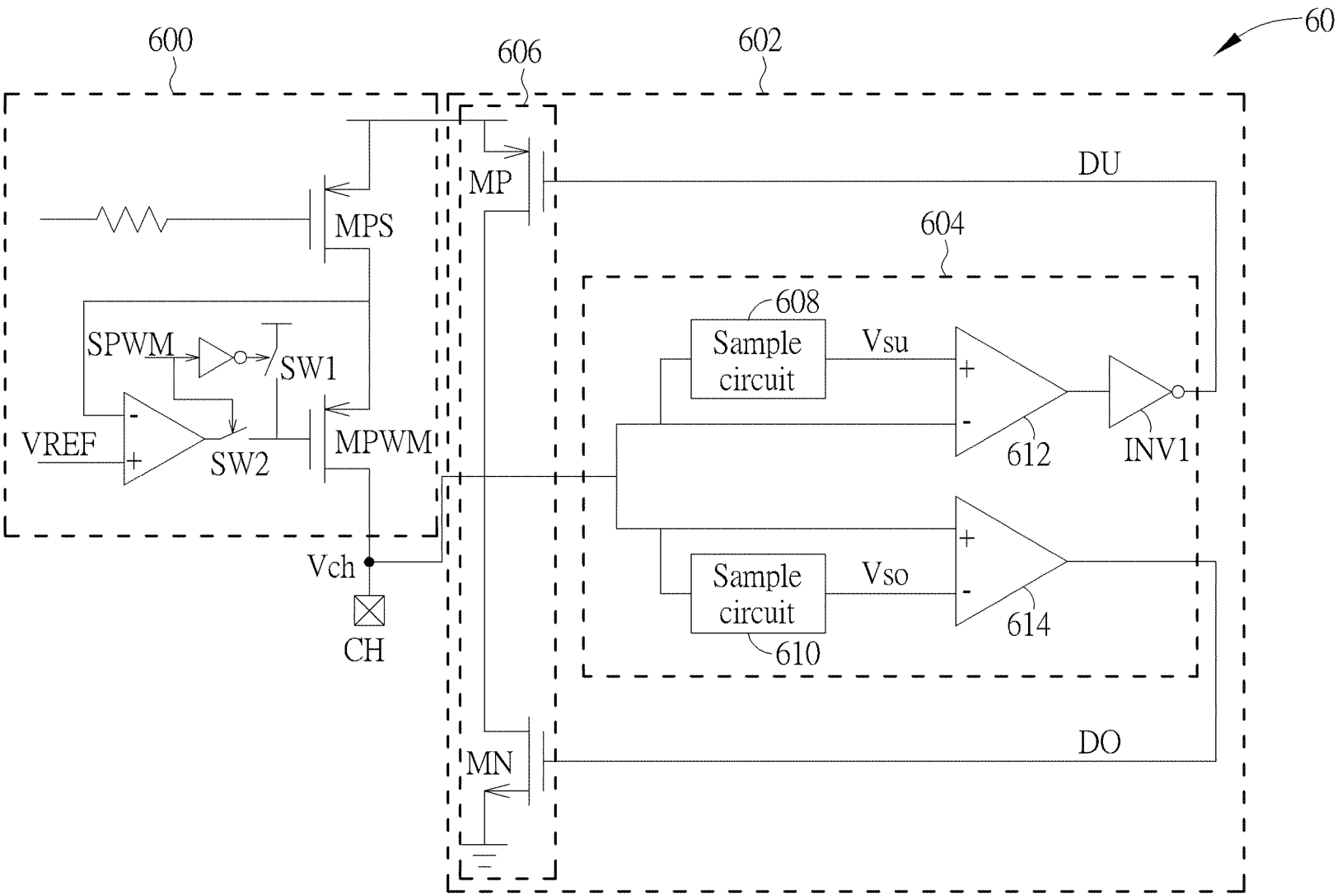
FIG. 6 is a schematic diagram of a portion of a light emitting diode driver according to an embodiment of the present invention.

Please refer to FIG. 6, which is a schematic diagram of a portion of a light emitting diode (LED) driver 60 according to an embodiment of the present invention. As shown in FIG. 6, the light emitting diode driver 60 is utilized for driving an LED panel, and includes a constant current circuit 600 and a coupling compensation module 602. The constant current circuit 600 may be each pair of the constant current source and the pulse width modulation (PWM) switch shown in FIG. 1, FIG. 3 and FIG. 5, and outputs a channel voltage Vch (i.e. a conduction voltage of a corresponding LED) when a corresponding channel CH is turned on. The coupling compensation module 602 includes a detecting circuit 604 and a compensation circuit 606. The detecting circuit 604 detects a voltage variation of the channel voltage Vch, to generate a detection result, and the compensation circuit 606 compensates the voltage variation of the channel voltage Vch (i.e. brightness compensation) according to the detection result.

In detail, when the channel CH is turned on, and another channel of the light emitting diode driver 60 is simultaneously switched from turned on to turned off or switched from turned off to turned on, the channel voltage Vch of the channel CH falls or rises due to capacitive coupling. Under such a situation, the detection result indicates that the channel voltage Vch falls or rises, and the compensation circuit 606 raises or reduces the channel voltage Vch. As a result, the present invention may compensate the voltage variation of the channel voltage Vch, and thus drive LED pixels of the LED panel to display desirable brightness.

Specifically, in the constant current circuit 600, a constant current transistor MPS receives a fixed voltage at its gate to provide a constant channel current (i.e. a constant current source). A switch SW1 is coupled between a supply voltage and a gate of a pulse width modulation transistor MPWM, and is controlled by an inverted signal of a pulse width modulation signal SPWM, to control the gate of the pulse width modulation transistor MPWM to be at a high level (e.g. the supply voltage) or turned off when the pulse width modulation signal SPWM is at a low level. Another switch SW2 is coupled between an output terminal of an amplifier and the gate of the pulse width modulation transistor MPWM, and is controlled by the pulse width modulation signal SPWM, to form a negative feedback loop to lock a source voltage of the pulse width modulation transistor MPWM at a reference voltage VREF when the pulse width modulation signal PWM is at a high level, such that the pulse width modulation transistor MPWM is turned on to output the constant channel current to drive a corresponding LED and generate the channel voltage Vch (i.e. the conduction voltage of the LED).

Besides, the detecting circuit 604 includes sample circuits 608, 610, comparators 612, 614 and an inverter INV1, and the compensation circuit 606 includes transistors MP, MN. In detail, the sample circuit 608 samples and holds the channel voltage Vch when the channel CH is turned on, to generate a sample voltage Vsu. The comparator 612 compares the channel voltage Vch with the sample voltage Vsu, to generate a first comparison result indicating whether the channel voltage Vch is less than the sample voltage Vsu over a first threshold voltage difference ΔVth. The inverter INV1 receives the first comparison result to generate a first inverted signal as an undershoot detection DU of the detection result. When the undershoot detection DU indicates that the channel voltage Vch is less than the sample voltage Vsu over the threshold voltage difference ΔVth, the transistor MP provides currents to the channel CH to raise the channel voltage Vch. As a result, the present invention raises the channel voltage Vch when the channel CH is turned on and the channel voltage Vch falls more than the threshold voltage difference ΔVth (which avoids mistaken operation when there is no coupling from other channels).

On the other hand, the sample circuit 610 samples and holds the channel voltage Vch when the channel CH is turned on, to generate a sample voltage Vso. The comparator 612 compares the channel voltage Vch with the sample voltage Vso, to generate a second comparison result as an overshoot detection DO of the detection result indicating whether the channel voltage Vch is greater than the second sample voltage Vso over a second threshold voltage difference (e.g. the second threshold voltage difference is the same with the first threshold voltage difference ΔVth in this embodiment, but may be different from the first threshold voltage difference ΔVth in other embodiments). When the overshoot detection DO indicates that the channel voltage Vch is greater than the second sample voltage Vso over the threshold voltage difference ΔVth, the transistor MN drains currents from the channel CH to reduce the channel voltage Vch. As a result, the present invention reduces the channel voltage Vch when the channel CH is turned on and the channel voltage Vch raises more than the threshold voltage difference ΔVth.

Figure 7:
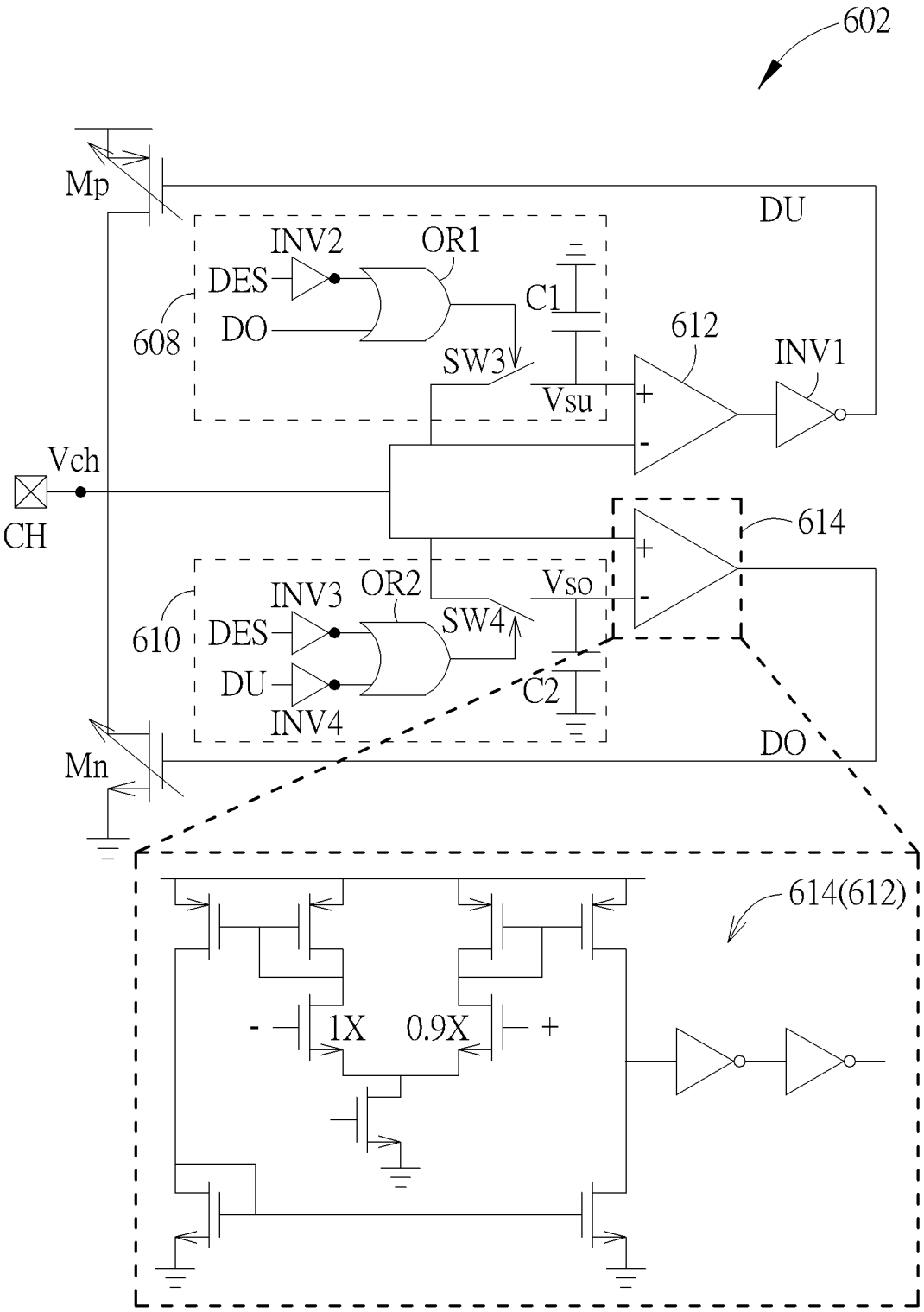
FIG. 7 is a detail circuit diagram of the coupling compensation module shown in FIG. 6 according to an embodiment of the present invention.

In detail, please refer to FIG. 7, which is a detail circuit diagram of the coupling compensation module 602 shown in FIG. 6 according to an embodiment of the present invention. As shown in FIG. 7, the sample circuit 608 includes an inverter INV2, an OR gate OR1, a switch SW3 and a capacitor C1. The inverter INV2 receives a decouple enable signal DES to generate a second inverted signal. The OR gate OR1 receives the second inverted signal and the overshoot detection DO, to generate a first operational result. The switch SW3 is coupled between the channel CH and a positive input terminal of the comparator 612 and includes a control terminal for receiving the first operational result. The capacitor C1 is coupled between a ground and the positive input terminal of the comparator 612, and provides the sample voltage Vsu.

On the other hand, the sample circuit 610 includes inverters INV3, INV4, an OR gate OR2, a switch SW4 and a capacitor C2. The inverter INV3 receives the decouple enable signal DES to generate a third inverted signal. The inverter INV4 receives an undershoot detection DU to generate a fourth inverted signal. The OR gate OR2 receives the third inverted signal and the fourth inverted signal, to generate a second operational result. The switch SW4 is coupled between the channel CH and a negative input terminal of the comparator 614 and includes a control terminal for receiving the second operational result. The capacitor C2 is coupled between a ground and the negative input terminal of the comparator 614, and provides the sample voltage Vso.

Besides, the comparator 614 or 612 may be implemented by the circuit shown in the dotted box, and include a mismatched input pair, wherein a channel width of a transistor of the positive input terminal is less than a channel width of a transistor of the negative input terminal (0.9× vs. 1×). Thus, the comparator 614 or 612 outputs a comparison result with a high voltage level when a voltage of the positive input terminal is greater than a voltage of the negative input terminal over the threshold voltage difference ΔVth. Moreover, the transistors MP, MN have adjustable driving capabilities, and provide appropriate driving capabilities for different LEDs with different characteristics.

Figure 8:
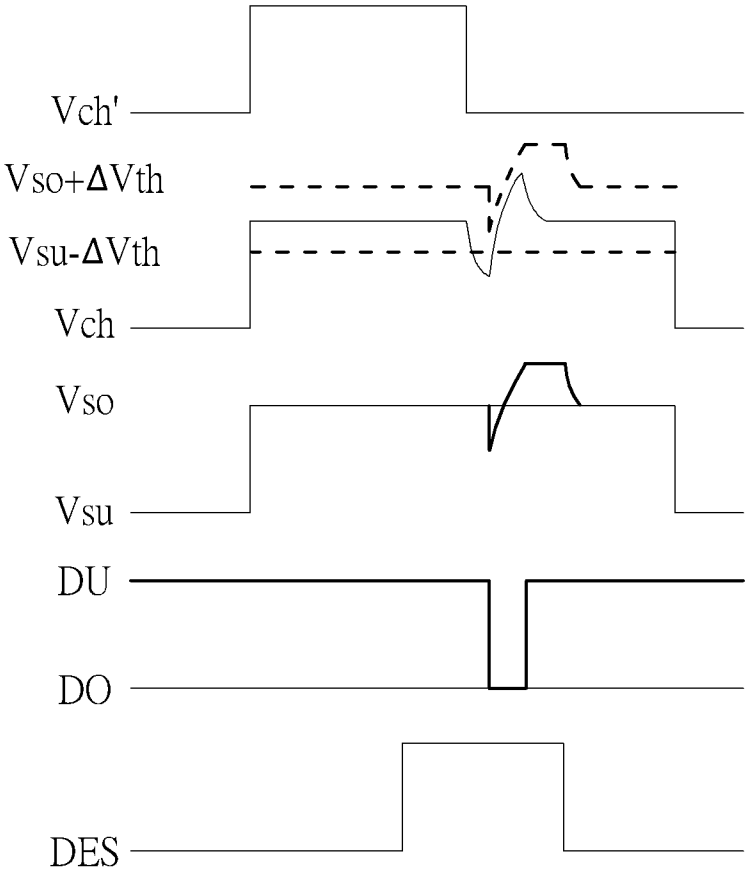
FIG. 8 is a schematic diagram of an operation of the coupling compensation module shown in FIG. 7 according to an embodiment of the present invention.

Under such a configuration, please refer to FIG. 8, which is a schematic diagram of an operation of the coupling compensation module 602 shown in FIG. 7 according to an embodiment of the present invention. As shown in FIG. 7 and FIG. 8, when the channel CH is turned on and another channel with a channel voltage Vch' is about to be turned off, the decouple enable signal DEC (provided by a timing controller) is triggered for a specific interval. When the decouple enable signal DEC is high and the overshoot detection DO is low (will be described in detail later), the first operational result is low, such that the switch SW3 is turned off to sample the current channel voltage Vch as the sample voltage Vsu in the capacitor C1. Then, when the channel with the channel voltage Vch' is turned off, the channel voltage Vch falls. When the channel voltage Vch falls more than the threshold voltage difference ΔVth, the comparator 612 outputs the first comparison result to be high (the high first comparison result is delayed and extended by the comparator 612 for practical compensation requirements). Afterwards, since the undershoot detection DU is low in response to the high first comparison result, the transistor MP provides currents to the channel CH to raise the channel voltage Vch. In the meantime, the undershoot detection DU is low and thus the second operational result is high, such that the sample voltage Vso is equal to the channel voltage Vch, thereby preventing the channel voltage Vch from rising above the sample voltage Vso plus the threshold voltage difference ΔVth and erroneously triggering the transistor MN.

Figure 9:
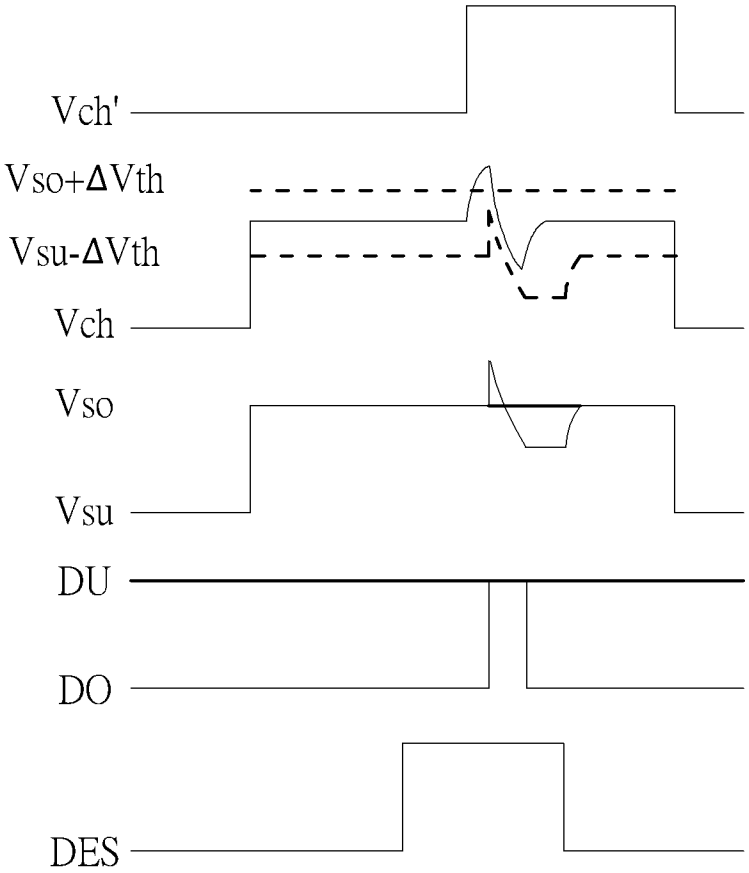
FIG. 9 is a schematic diagram of another operation of the coupling compensation module shown in FIG. 7 according to an embodiment of the present invention.

On the other hand, please refer to FIG. 9, which is a schematic diagram of another operation of the coupling compensation module 602 shown in FIG. 7 according to an embodiment of the present invention. As shown in FIG. 7 and FIG. 9, when the channel CH is turned on and another channel with the channel voltage Vch' is about to be turned on, the decouple enable signal DEC (provided by a timing controller) is triggered for a specific interval. When the decouple enable signal DEC is high and the undershoot detection DU is high (will be described in detail later), the second operational result is low, such that the switch SW4 is turned off to sample the current channel voltage Vch as the sample voltage Vso in the capacitor C2. Then, when the channel with the channel voltage Vch' is turned on, the channel voltage Vch rises. When the channel voltage Vch rises by more than the threshold voltage difference ΔVth, the comparator 614 outputs the overshoot detection DO to be high (the high overshoot detection DO is delayed and extended by the comparator 614 for practical compensation requirements). Afterwards, since the overshoot detection DO is high, the transistor MN drains currents from the channel CH to reduce the channel voltage Vch. In the meantime, the overshoot detection DO is high and thus the first operational result is high, such that the sample voltage Vsu is equal to the channel voltage Vch, thereby preventing the channel voltage Vch from rising above the sample voltage Vso plus the threshold voltage difference ΔVth and erroneously triggering the transistor MP.

Figure 10:
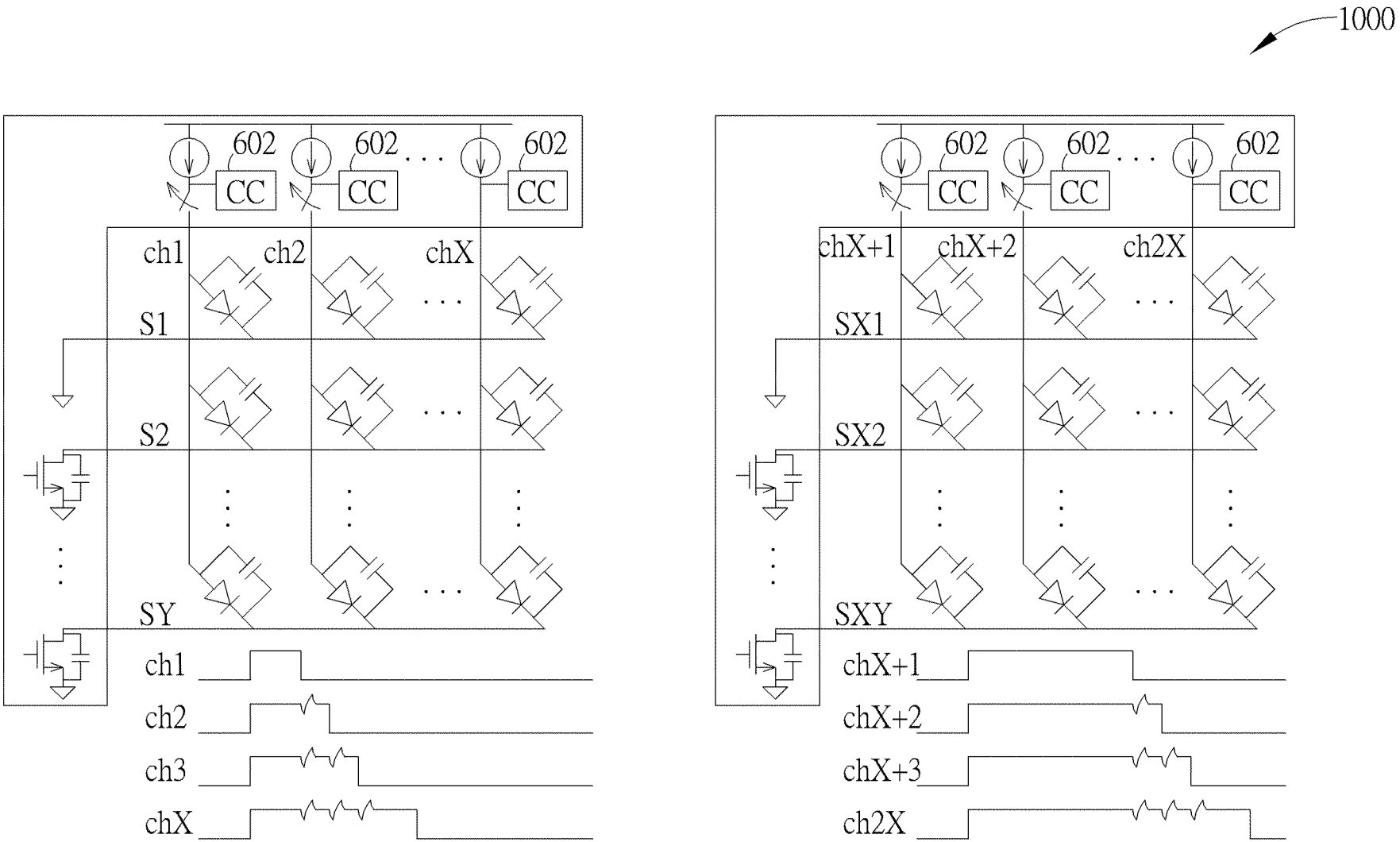
FIG. 10 is a schematic diagram of an LED display panel 100 with an assembly and extension structure according to an embodiment of the present invention.

Please refer to FIG. 10, which is a schematic diagram of an LED display panel 1000 with an assembly and extension structure according to an embodiment of the present invention. The LED display panel 1000 is similar to the LED display panel 30, and thus elements with similar functions are denoted by the same symbol. The main difference between the LED display panel 1000 and the LED display panel 30 is that each channel is implemented with a coupling compensation module 602, to compensate the voltage variation of each channel by appropriately raising each channel voltage, and thus drive LED pixels of the LED display panel 1000 to display desirable brightness. As a result, the area displayed by the channel chX and the area displayed by the channel chX+1 have substantially brightness and thus there is smooth in between (not shown).

Noticeably, the above embodiment compensates the voltage variation of each channel due to capacitive coupling, and thus drives LED pixels of the LED panel to display desirable brightness. Those skilled in the art may make modifications or alterations accordingly. For example, each channel of the LED display panel 30 shown in FIG. 5 may also be implemented with a coupling compensation module 602, to compensate the voltage variation of each channel by appropriately reducing each channel voltage, and thus drive LED pixels of the modified LED display panel to display desirable brightness. Besides, light emitting diode pixels in different channels may have the same color (e.g. all green channels) or different colors (e.g. a red channel, a green channel and a blue channel are arranged sequentially and repetitively).

Figure 2:
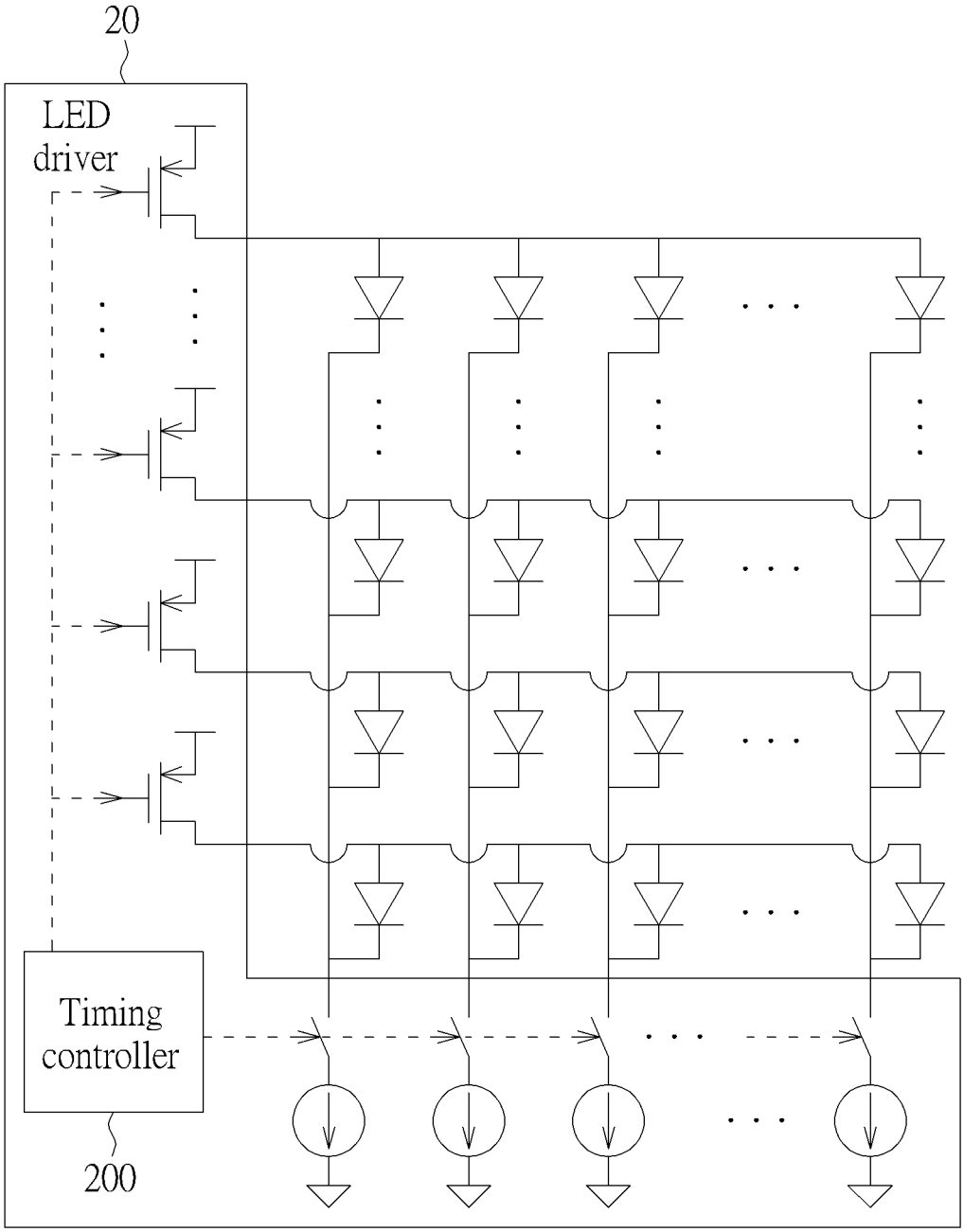
FIG. 2 PRIOR ART
FIG. 2 is a schematic diagram of a passive matrix common anode driving structure.

Moreover, in the above embodiment, the coupling compensation module 602 detects the voltage variation of the channel voltage Vch in the passive matrix common cathode driving structure, wherein the channel voltage Vch is an anode voltage of an anode of an LED. In other embodiments, the coupling compensation module 602 may also detect a voltage variation of a channel voltage in the passive matrix common anode driving structure as shown in FIG. 2, wherein the channel voltage is a cathode voltage of a cathode of an LED.

To sum up, the present invention compensates the voltage variation of each channel due to capacitive coupling, and thus drives LED pixels of the LED panel to display desirable brightness.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A coupling compensation module, for compensating a channel voltage of a channel outputted by a constant current circuit of a light emitting diode (LED) driver, comprising:

a detecting circuit, for detecting a voltage variation of the channel voltage, to generate a detection result, wherein the detecting circuit comprises:

a first sample circuit, for sampling and holding the channel voltage when the channel is turned on, to generate a first sample voltage;

a first comparator, for comparing the channel voltage with the first sample voltage, to generate a first comparison result indicating whether the channel voltage is less than the first sample voltage over a first threshold voltage difference; and a first inverter, for receiving the first comparison result to generate a first inverted signal as an undershoot detection of the detection result; and a compensation circuit, for compensating the voltage variation of the channel voltage according to the detection result.

2. The coupling compensation module of claim 1, wherein the compensation circuit raises or reduces the channel voltage when the detection result indicates that the channel voltage falls or rises.

3. The coupling compensation module of claim 1, wherein the compensation circuit comprises a first transistor, for raising the channel voltage when the undershoot detection indicates that the channel voltage is less than the first sample voltage over the first threshold voltage difference.

4. The coupling compensation module of claim 1, wherein the first sample circuit comprises:

a second inverter, for receiving a decouple enable signal to generate a second inverted signal;

a first OR gate, for receiving the second inverted signal and an overshoot detection, to generate a first operational result;

a first switch, coupled between the channel and a positive input terminal of the first comparator, comprising a control terminal for receiving the first operational result; and a first capacitor, coupled between a ground and the positive input terminal of the first comparator, for providing the first sample voltage.

5. The coupling compensation module of claim 1, wherein the first comparator comprises a mismatched first input pair.

6. The coupling compensation module of claim 1, wherein the detecting circuit comprises:

a second sample circuit, for sampling and holding the channel voltage when the channel is turned on, to generate a second sample voltage; and a second comparator, for comparing the channel voltage with the second sample voltage, to generate a second comparison result as an overshoot detection of the detection result indicating whether the channel voltage is greater than the second sample voltage over a second threshold voltage difference.

7. The coupling compensation module of claim 6, wherein the compensation circuit comprises a second transistor, for reducing the channel voltage when the overshoot detection indicates that the channel voltage is greater than the second sample voltage over the second threshold voltage difference.

8. The coupling compensation module of claim 6, wherein the second sample circuit comprises:

a third inverter, for receiving a decouple enable signal to generate a third inverted signal;

a fourth inverter, for receiving the undershoot detection to generate a fourth inverted signal;

a second OR gate, for receiving the third inverted signal and the fourth inverted signal, to generate a second operational result;

a second switch, coupled between the channel and a negative input terminal of the second comparator, comprising a control terminal for receiving the second operational result; and a second capacitor, coupled between a ground and the negative input terminal of the second comparator, for providing the second sample voltage.

9. The coupling compensation module of claim 6, wherein the second comparator comprises a mismatched second input pair.

10. The coupling compensation module of claim 1, wherein when the channel is turned on and another channel is about to be turned on or turned off, a decouple enable signal is triggered for a specific interval.

11. The coupling compensation module of claim 1, wherein the channel voltage is an anode voltage when the LED driver is implemented in a passive matrix common cathode driving structure, and the channel voltage is a cathode voltage when the LED driver is implemented in a passive matrix common anode driving structure.

12. A light emitting diode (LED) driver, for driving an LED panel, comprising:

a constant current circuit, for outputting a channel voltage of a channel; and a coupling compensation module, comprising:

a detecting circuit, for detecting a voltage variation of the channel voltage, to generation a detection result, wherein the detecting circuit comprises:

a first sample circuit, for sampling and holding the channel voltage when the channel is turned on, to generate a first sample voltage;

a first comparator, for comparing the channel voltage with the first sample voltage, to generate a first comparison result indicating whether the channel voltage is less than the first sample voltage over a first threshold voltage difference; and a first inverter, for receiving the first comparison result to generate a first inverted signal as an undershoot detection of the detection result; and a compensation circuit, for compensating the voltage variation of the channel voltage according to the detection result.

13. The LED driver of claim 12, wherein the compensation circuit raises or reduces the channel voltage when the detection result indicates that the channel voltage falls or rises.

14. The LED driver of claim 12, wherein the compensation circuit comprises a first transistor, for raising the channel voltage when the undershoot detection indicates that the channel voltage is less than the first sample voltage over the first threshold voltage difference.

15. The LED driver of claim 12, wherein the first sample circuit comprises:

a second inverter, for receiving a decouple enable signal to generate a second inverted signal;

a first OR gate, for receiving the second inverted signal and an overshoot detection, to generate a first operational result;

a first switch, coupled between the channel and a positive input terminal of the first comparator, comprising a control terminal for receiving the first operational result; and a first capacitor, coupled between a ground and the positive input terminal of the first comparator, for providing the first sample voltage.

16. The LED driver of claim 12, wherein the first comparator comprises a mismatched first input pair.

17. The LED driver of claim 12, wherein the detecting circuit comprises:

a second sample circuit, for sampling and holding the channel voltage when the channel is turned on, to generate a second sample voltage; and a second comparator, for comparing the channel voltage with the second sample voltage, to generate a second comparison result as an overshoot detection of the detection result indicating whether the channel voltage is greater than the second sample voltage over a second threshold voltage difference.

18. The LED driver of claim 17, wherein the compensation circuit comprises a second transistor, for reducing the channel voltage when the overshoot detection indicates that the channel voltage is greater than the second sample voltage over the second threshold voltage difference.

19. The LED driver of claim 17, wherein the second sample circuit comprises:

a third inverter, for receiving a decouple enable signal to generate a third inverted signal;

a fourth inverter, for receiving the undershoot detection to generate a fourth inverted signal;

a second OR gate, for receiving the third inverted signal and the fourth inverted signal, to generate a second operational result;

a second switch, coupled between the channel and a negative input terminal of the second comparator, comprising a control terminal for receiving the second operational result; and a second capacitor, coupled between a ground and the negative input terminal of the second comparator, for providing the second sample voltage.

20. The LED driver of claim 17, wherein the second comparator comprises a mismatched second input pair.

21. The LED driver of claim 12, wherein when the channel is turned on and another channel is about to be turned on or turned off, a decouple enable signal is triggered for a specific interval.

22. The LED driver of claim 12, wherein the channel voltage is an anode voltage when the LED driver is implemented in a passive matrix common cathode driving structure, and the channel voltage is a cathode voltage when the LED driver is implemented in a passive matrix common anode driving structure.

* * * * *